United States Patent [19]

Dobry et al.

[11] Patent Number: 5,050,689

[45] Date of Patent: Sep. 24, 1991

[54] COMPRESSED AIR SUPPLY SYSTEM OF VIBRO-ISOLATED TOOLS

[75] Inventors: Marian W. Dobry; Czesław Cempel; Wieslaw Garbatowski, all of Poznán, Poland

[73] Assignee: Politechnika Poznanska, Poznan, Poland

[21] Appl. No.: 525,293

[22] Filed: May 16, 1990

Related U.S. Application Data

[63] Continuation of Ser. No. 325,192, Mar. 16, 1989, abandoned.

[30] Foreign Application Priority Data

Mar. 29, 1988 [PL] Poland ..... 271524

[51] Int. Cl.[5] ..... B25D 17/24

[52] U.S. Cl. ..... 173/162.002; 173/169

[58] Field of Search ..... 173/162.1, 162.2, 168, 173/169

[56] References Cited

U.S. PATENT DOCUMENTS 2,899,934 8/1959 Salengro ..... 173/162.2 X
3,306,172 2/1967 Attebo ..... 173/162.1 X

FOREIGN PATENT DOCUMENTS 115085 7/1982 Poland .
118242 4/1983 Poland .
121231 10/1983 Poland .
122381 6/1984 Poland .
128491 8/1985 Poland .
122477 12/1985 Poland .

OTHER PUBLICATIONS

Bychowskij, Goldstein—"Osnowy Konstruriowanije Wibrobezopastnych Wibrobezopastnych Rucznych Maszyn", Moscow 1982, pp. 177-178.

Atlas Copco—Hand Tools Catalog—Hammer RR D 36.

*Primary Examiner*—Frank T. Yost
*Assistant Examiner*—Scott A. Smith
*Attorney, Agent, or Firm*—Ladas & Parry

[57] ABSTRACT

A compressed air supply system for vibro-isolated tools comprises a telescopic-tubular connection between the tool grip and the tool compressed air engine. A cut-off valve is mounted at the inlet to a supply duct through the grip, the outlet of the duct being connected to a pipe of the supply system mounted in the grip by means of an elastic connection. The pipe of the supply system has holes through the wall thereof with increasing diameters which, during motion of the tool housing relative to the compressed air engine, overlap with holes in an intermediate sleeve into which the air supply pipe slidably extends. The intermediate sleeve conveys the air to the air engine.

1 Claim, 1 Drawing Sheet

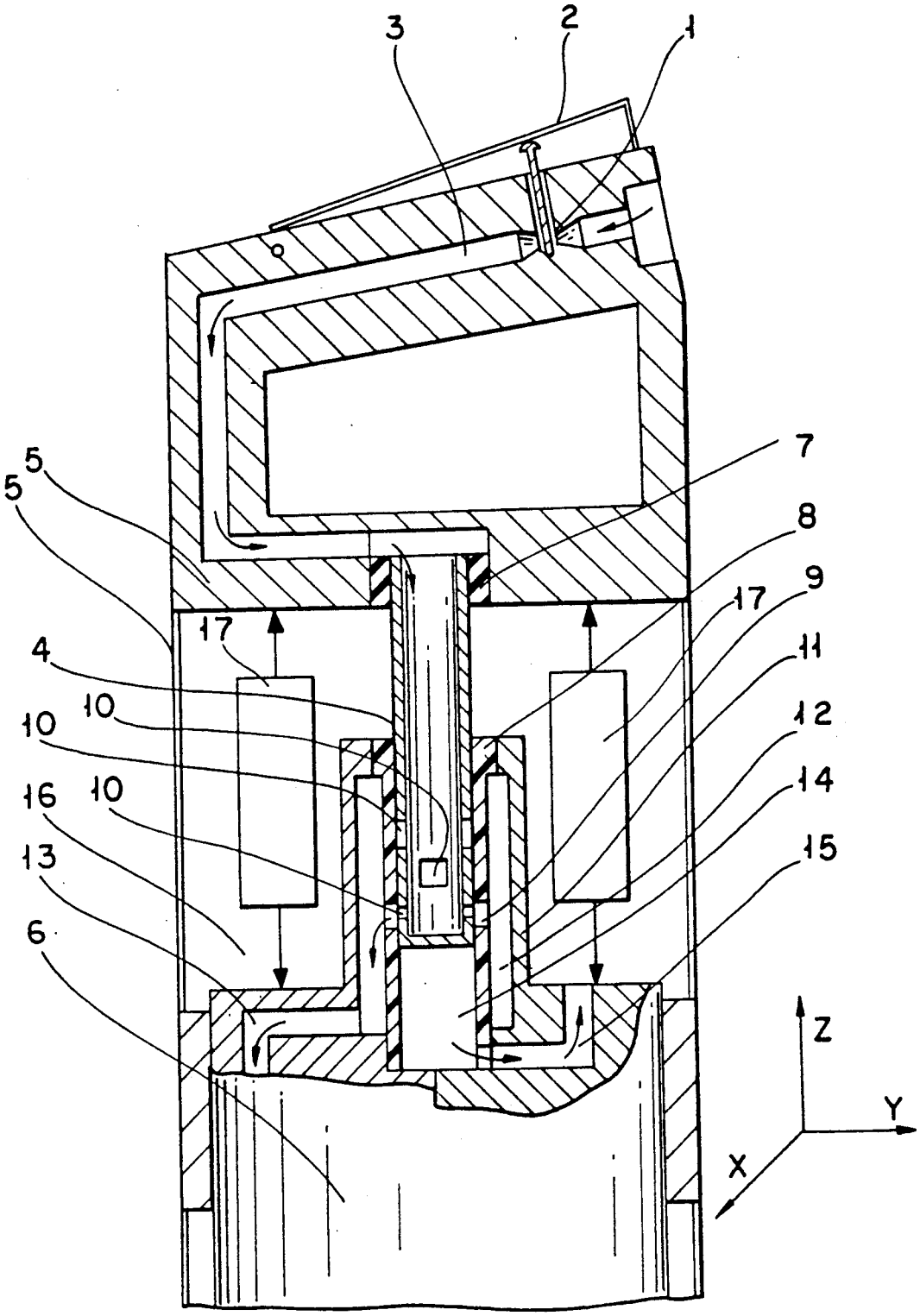
3
2
1
5
5
7
8
9
17
17
11
4
10
12
10
14
16
10
15
13
6
Z
Y
X

COMPRESSED AIR SUPPLY SYSTEM OF VIBRO-ISOLATED TOOLS

BACKGROUND OF THE INVENTION

This invention relates to a compressed-air supply system of vibro-isolated tools which eliminates grip vibration produced by air pressure pulsations in the supply duct and a working compressed-air engine.

The designs of pneumatic hammers known from published Patent Specifications have various supply systems, the designs of which have been determined by the introduced vibro-isolation. So, for instance, the pneumatic hammer known from the Polish Patent Specification No. 122477 has a shock absorber, wherein the introduction of vibro-isolation requires application of an intermediate sleeve which connects the body of the compressed-air engine to the grip. The intermediate sleeve is a connector between the housing of the hammer and the body and transmits the pressure force exerted by the operator on the housing to the body of the hammer. In this way also vibration from the heavily vibrating hammer body is carried onto the housing.

Such a design doesn't ensure a spatial vibroisolation in the directions perpendicular to the axes of symmetry of the hammer.

Similar disadvantages are also characteristic for the pneumatic hammer presented in the Polish Patent Specification No. 122381.

The supply system of that hammer is provided with two supply tubes mounted in the body-housing which coact slidably with holes made in the engine body.

Introduction of the above mentioned supply pipes which simultaneously serve as a protection against revolution is practically troublesome and can lead to jamming of the hammer in the housing. Moreover, the supply system does not eliminate low-frequency vibration of the grip produced by pulsation of air pressure in the inlet duct.

SUMMARY OF THE INVENTION

A supply system according to this invention has a telescopic-tubular air supply connection of the housing-grip with the compressed-air engine. A cut-off valve is installed at the inlet to the duct made in the housing-grip, the outlet of the duct being connected to a supply pipe closed at one end, the other end of which is mounted in the housing-grip by means of an elastic connection. Moreover, in the circumference of the supply pipe there are holes with increasing diameters, which during the motion of the housing relative to the compressed-air engine overlap with holes in an intermediate sleeve mounted in the body of the compressed-air engine.

It is advisable to make in the intermediate sleeve, as well as in the body of the compressed-air engine, ducts for exhausting the space formed in the intermediate sleeve between the closed end of the supply pipe and the air engine.

The system according to this invention makes possible an infinitely variable variation of the flow rate of supply air and its delivery to the body of the compressed air engine with a free motion of the engine body and elimination of the pulsating uplift pressure force produced by pressure pulsation in the supply duct. The system is provided with a cut-off valve and, in consequence, the compressed-air engine can be supplied with air at a very low flow rate for checking the tool for proper operation. In order to reduce the friction forces, an intermediate sleeve made of plastic with a very low coefficient of friction and a considerable damping coefficient is used in the air supply system.

The described system is relatively simple and easy to make and does not adversely affect other vibro-isolation elements of the tool.

DESCRIPTION OF THE DRAWING

FIG. 1 shows diagrammatically the inventive supply system used in an illustrative vibro-isolated tool.

DESCRIPTION OF A PREFERRED EMBODIMENT

The supply system for supplying compressed-air to vibro-isolated tools has been provided with a cut-off valve 1 which is actuated by pressing slightly a valve arm 2 mounted on the housing-grip 5 of the tool. Compressed air flows through a duct 3 through the housing-grip 5 to a pipe 4 of the supply unit. The pipe 4 of the supply unit is mounted, at its open end, elastically by means of a connection 7 of the silent-block type in the housing-grip 5 which enables the pipe to move slightly in the directions x and y together with the vibrating body 6 of the compressed-air engine. In this way a second stage of vibro-isolation is obtained. The supply pipe 4 is slidably mounted within an intermediate sleeve 8 made of a material with a small coefficient of friction and a considerable damping coefficient mounted in the body 6 of the compressed-air engine. The intermediate sleeve 8 is also the first stage of vibro-isolation on the way from the body 6 of the compressed air engine to the housing-grip 5. In the intermediate sleeve 8 on the side wall there are holes 9 through which supply air flows from the pipe 4 of the supply unit when the holes 9 are overlapped with holes 10 in the pipe 4. Adjustment of the flow rate is connected with the depth of insertion of the pipe 4 of the supply unit into the intermediate sleeve 8, which is controlled by the operator using the tool. Supply air outflows from the holes 9 of the intermediate sleeve 8 to the space 12 formed between the stub pipe 11 and the intermediate sleeve 8. From the space 12, air is directed through duct 13 to the compressed air engine 6. The space 14 formed in the intermediate sleeve 8 between the closed end of the pipe 4 and the air engine is connected through a duct 15 to the space 16 surrounding a vibro-isolator 17 with a constant reaction force.

We claim:

1. A compressed-air supply system for a tool comprising:

a housing including a grip for holding and manipulating said tool, a compressed air engine vibrating within the housing, an air duct extending through said grip, said duct having an air inlet and an air outlet, a valve mounted at the inlet to said air duct, an air conducting pipe mounted at the outlet of said air duct, said pipe extending from said grip, one end of said pipe being secured to said grip by means of an elastic connection to provide vibroisolation of said pipe within said grip, the other end of said pipe being closed, the wall of said pipe having openings therethrough spaced apart along the length of the pipe, said holes being of differing diameter, an air inlet sleeve for said compressed air engine mounted on its body, said closed end of said pipe extending into said sleeve and being axially movable relative thereto, the wall of said sleeve having a hole therethrough providing a path for supply air to said engine, the holes of said pipe being positioned to individually overlap the hole through said sleeve depending upon the relative position of said pipe within said sleeve, and means for venting the space formed in said air inlet sleeve between said closed end of said pipe and said body of said engine.

* * * * *